US005253505A

United States Patent [19]

Baur

[11] Patent Number: 5,253,505

[45] Date of Patent: Oct. 19, 1993

[54] PRESS WITH A DRAWING APPARATUS

[75] Inventor: Siegfried Baur, Göppingen, Fed. Rep. of Germany

[73] Assignee: L. Schuler Pressen GmbH, Fed. Rep. of Germany

[21] Appl. No.: 887,059

[22] Filed: May 22, 1992

[30] Foreign Application Priority Data

May 25, 1991 [DE] Fed. Rep. of Germany ..... 4117102

[51] Int. Cl.[5] ..... B21D 43/05

[52] U.S. Cl. ..... 72/361; 72/405

[58] Field of Search ..... 72/351, 345, 346, 405, 72/361; 267/119

[56] References Cited

U.S. PATENT DOCUMENTS 1,742,877 1/1930 Rode et al. ..... 267/119
4,566,306 1/1986 Orii ..... 72/346
4,712,412 12/1987 Roos et al. .
4,840,055 6/1989 Michael et al. .
5,099,673 3/1992 Baur ..... 72/351

FOREIGN PATENT DOCUMENTS 656684 2/1938 Fed. Rep. of Germany .
2408096 8/1975 Fed. Rep. of Germany .

*Primary Examiner*—Lowell A. Larson
*Attorney, Agent, or Firm*—Evenson, McKeown, Edwards & Lenahan

[57] ABSTRACT

A press having a drawing apparatus has a sheet metal part that is drawn in the drawing stage. This sheet metal part is to be taken over by a transfer device in a stage of the upward movement of the drawing apparatus that is as early as possible in order to utilize the long time period of the upward movement of the slide for the transfer movement. After the drawing, passing through the lower dead center of the slide movement and the drawing apparatus movement, the sheet metal holder is temporarily stopped in a removal position and is therefore temporarily prevented from continuing to move upward.

1 Claim, 5 Drawing Sheets

PRESS WITH A DRAWING APPARATUS

BACKGROUND AND SUMMARY OF THE INVENTION

The present invention relates to a press having a slide and a press bed for upper and lower parts of tools, a transfer device for the transport of sheet metal parts through the press, and a drawing apparatus with drawing cylinders fixed to the press frame which, during the shaping of the sheet metal parts, can be acted upon so that they can be lowered with the slide movement and, for the ejecting of the sheet metal parts from the bottom part of the tool, can be acted upon in a liftable manner and act from below on the tool-side sheet metal holder.

During the drawing in a press, the sheet metal part must be held against a contact pressure area in the top part of the tool by means of a sheet metal holder in the bottom part of the tool. After the drawing, the sheet metal part must be lifted up to the removal position for the transfer device. The blank-holding forces and the ejector forces or movements are applied by a drawing apparatus in the press bed below the bottom part of the tool. Up to now, the ejector movement had always taken place into a position which corresponded to the inserting position for the sheet part that follows. If the ejector movement carried out by the drawing apparatus had been interrupted temporarily, this took place for very different purposes.

In order to avoid a lifting of the pressure cheek that takes place at the same time as the upward movement of the press slide and thus an immediate lifting of the sheet metal part out of the bottom part of the tool, a locking cylinder is connected with the drawing apparatus in a device described in German Patent Document DE-PS 656 684.

From the German Patent Document DE-AS 24 08 096, it is known to let the piston rod of the drawing cylinder(s) and the piston rod of a locking cylinder act separately on the pressure cheek.

In the European Patent Document EP 0 276 672 A2, a drawing apparatus in a press is shown in which the locking arrangement can selectively be rendered operative or inoperative. In this case the drawing apparatus, as a whole, is rendered inoperative during certain machining stages.

Furthermore, it is known from German Patent Document DE 35 05 984 A1, in a drawing apparatus, to start the ejector movement of the sheet metal holder in a time-delayed manner following the upward movement of the slide. In this case, the speed of the ejector movement must be controlled into the receiving position which here also corresponds to the inserting position.

In German Patent Document DE 38 07 683 A1, the moving sequences, which are independent of the slide movement, such as the pre-accelerating and the ejecting, are to be controlled by means of a central unit in order to achieve a synchronizing of the pistons, which act in parallel, in the upward-moving stages, while they are mechanically independent of one another. Furthermore, by means of the central unit, the intermediate height adjustments of the sheet metal holder as well as its stroke starting position must be centrally presettable. For removal, the drawn sheet metal part is lifted into the inserting plane. For the temporary interruption of the ejector movement, the drawing cylinders interact with stopping cylinders during the ejection, the path of the stopping cylinders being controlled hydraulically.

A path-controlled stop for the temporary interruption of the ejector movement is also known from German Patent Document DE 40 32 338 A1. The drawing apparatus shown here acts upon a pressure cheek divided into segments. The drawing cylinders are fixedly arranged on the press. By way of forcing levers, the piston rods of the drawing cylinders act upon a liftable and lowerable console which, again by way of forcing levers, acts from below upon the segments of the pressure cheek. Locking cylinders are provided which are applied to the console by means of a lift bridge and, when acted upon by pressure, prevent an upward movement of the console and thus of the divided pressure cheek. The point in time of the stop in the upward-moving stage can be determined by a valve control of the pressure in the locking cylinders. The upward-carrying (ejector) movement of the pressure cheek is resumed at a point in time which is delayed with respect to the upward movement of the slide. In this case also, the sheet metal part is lifted into the upper position of the drawing apparatus which corresponds to the inserting position.

An object of the present invention is to remove the drawn sheet metal part from the sheet metal holder already in a stage of the upward movement of the drawing apparatus that is as early as possible in order to also utilize a long period of time of the upward movement of the slide for the transfer movement. For this purpose, the transfer device must be lowered further, and the movements of the transfer device and of the drawing apparatus and the point in time of the removal of the sheet metal part from the sheet metal holder must be controlled as a function of the slide movement, for example, as a function of the angle of rotation.

This and other objects are achieved by the present invention which provides a press having a press frame and at least one slide and a press bed for top and bottom parts of tools. The press bed has a tool-side sheet metal holder. The press also has a transfer device for transporting of sheet metal parts through the press, a drawing device with drawing cylinders which are fixed to the press frame and have piston rods which, during shaping of the sheet metal parts, can be acted upon so that the piston rods are lowerable with the slide movement and, for ejecting the sheet metal parts from the bottom part of the tool. The piston rods are liftable so as to act from below on the tool-side sheet metal holder. A liftable and lowerable console is provided through which the piston rods of the drawing cylinders act on the sheet metal holder. The console is operatively connected with at least one stop which is fixed to the press, and is removable in a controlled manner and has an adjustable stop position. The console, after passing through a lower dead center of the slide and the drawing device, is temporarily stopped as a function of a slide path or an angle of rotation in a removal position determinable by the stop.

Certain advantages result from the utilization of the upward moving stage of the slide for transfer movements. The number of strokes can be increased. Furthermore, larger transfer steps may take place. The lift-out movement by means of the drawing apparatus and the lifting movement of the sheet metal part by means of the transfer device can also be varied.

Other objects, advantages and novel features of the present invention will become apparent from the following detailed description of the invention when considered in conjunction with the accompanying drawings.

DETAILED DESCRIPTION OF THE DRAWINGS

Figure 1:
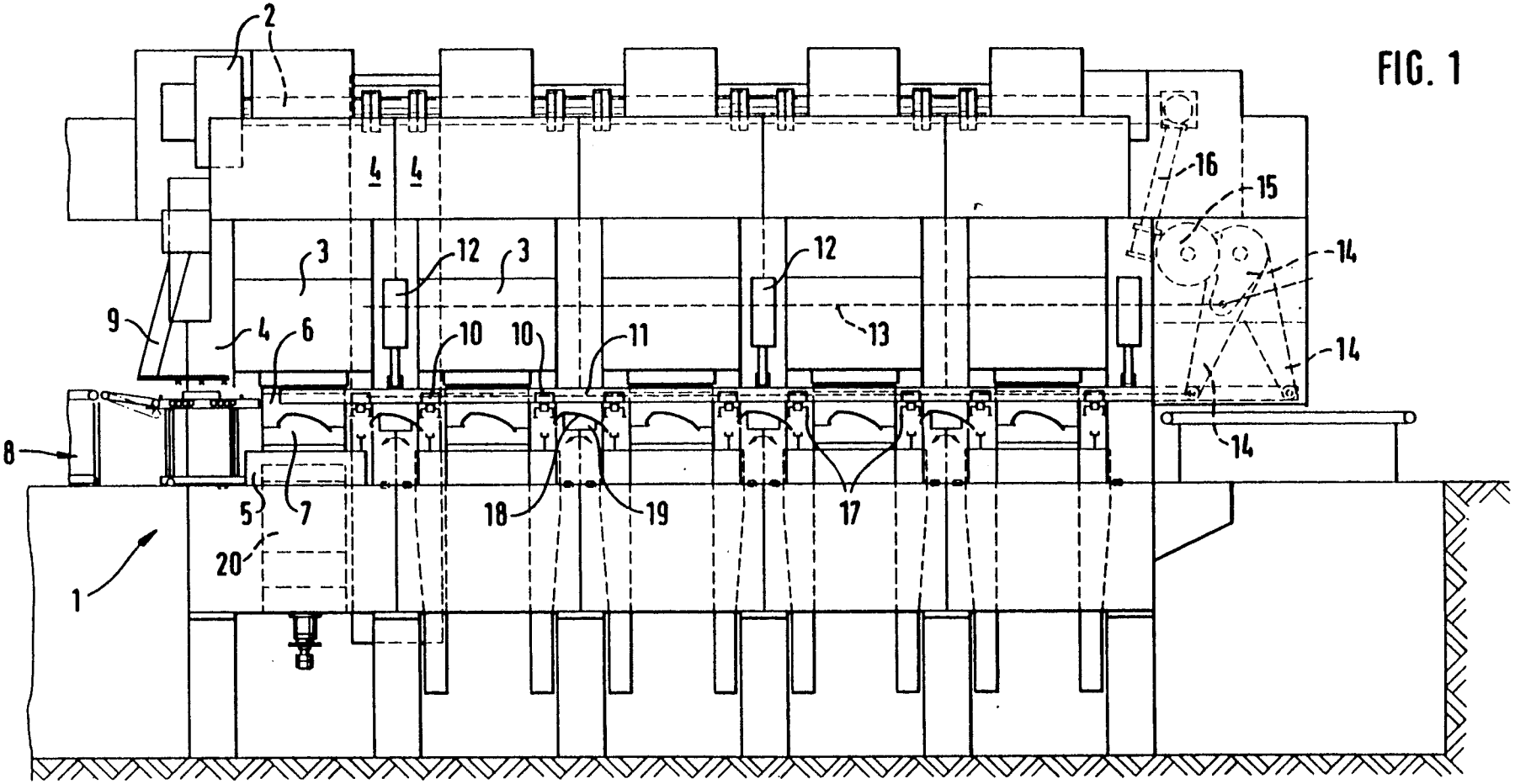
FIG. 1 is an overall view of a press system constructed in accordance with an embodiment of the present invention.

The press 1 illustrated in FIG. 1 has a main drive 2 comprising a motor, a main shaft, couplings and similar devices for the driving of slides 3 and of a transfer device 8. The slides 3 are guided in stands 4. The press 1 also has press beds 5. The press beds 5 may be movable out of the press 1 for the exchange of the tools or tools sets, of which, in the first machining stage which may be a drawing stage, one top part 6 of the tool and one bottom part 7 of the tool respectively are outlined.

The sheet metal parts 18 are inserted in the drawing station by means of feeders 9. The transfer movement of the sheet metal parts 18 in the machining stages, possibly with a temporary depositing on intermediate depositing devices 19, takes place by means of suction bars 10 of the transfer device 8. The suction bars 10 can be moved on slide rails 11 in the direction of and against the direction of the transfer movement for the sheet metal parts 18. For this purpose, a tapping of cams 15 takes place by means of one of the cam follower levers 14. The cams can be driven by the main drive 2 by means of a rotating shaft 16. Another tapping of the cam 15 takes place for the lifting and lowering by means of one of the cam follower levers 14, the transmission rod 13 and the deflecting gear 12 in the area of the stands 4. Gripping or sucking devices on the lifting bars 10 have the reference number 17, their lifting-lowering movements being adapted to the movement of the slide(s) 3 by the cam shape of the cams 14.

Figure 3:
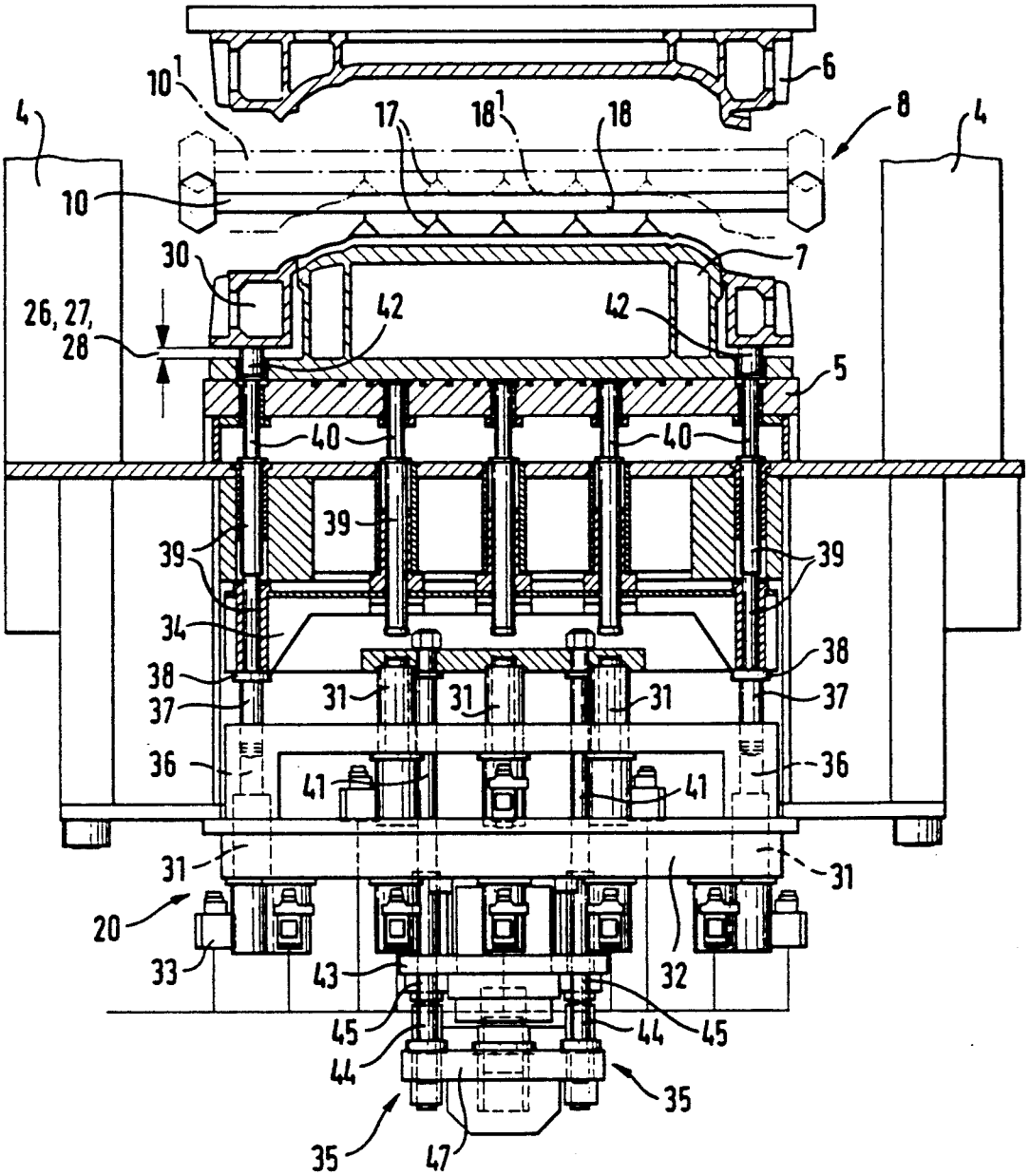
FIG. 3 is a sectional view of the drawing apparatus of the present invention without any pressure cheek.
Figure 4:
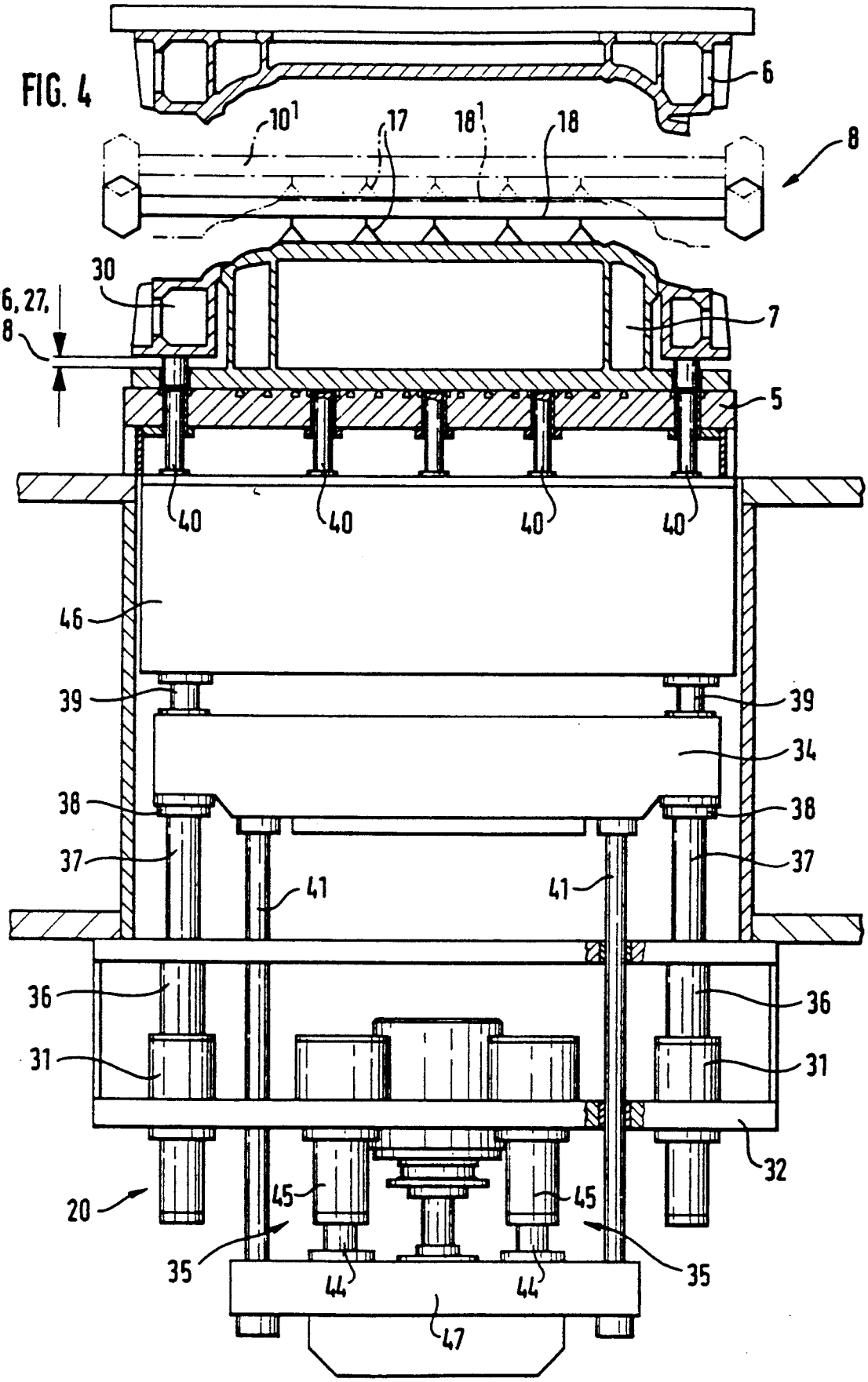
FIG. 4 is a sectional view of the drawing apparatus of the present invention with a pressure cheek.

Drawing apparatus 20 outlined in FIG. 1 is shown in detail in FIGS. 3 and 4 and is explained with respect to these figures. It is illustrated that the sheet metal parts 18 can be removed from the bottom parts 7 of the tools only after the opening of the individual tools. On the other hand, the invention utilizes the idea of providing access to the sheet metal part 18, for example, in the drawing stage, already in the upward-moving stage of the slide 3. This means that, by way of the press control, for example, as a function of the angle of rotation, the ejection of the sheet metal part 18 from the bottom part 7 of the tool starts with the beginning of the upward movement of the slide 3, and the suction bar 10 can be applied to the surface of the sheet metal part 18 when the correspondingly required opening width exists between the top part and the bottom part of the tool.

Figure 2:
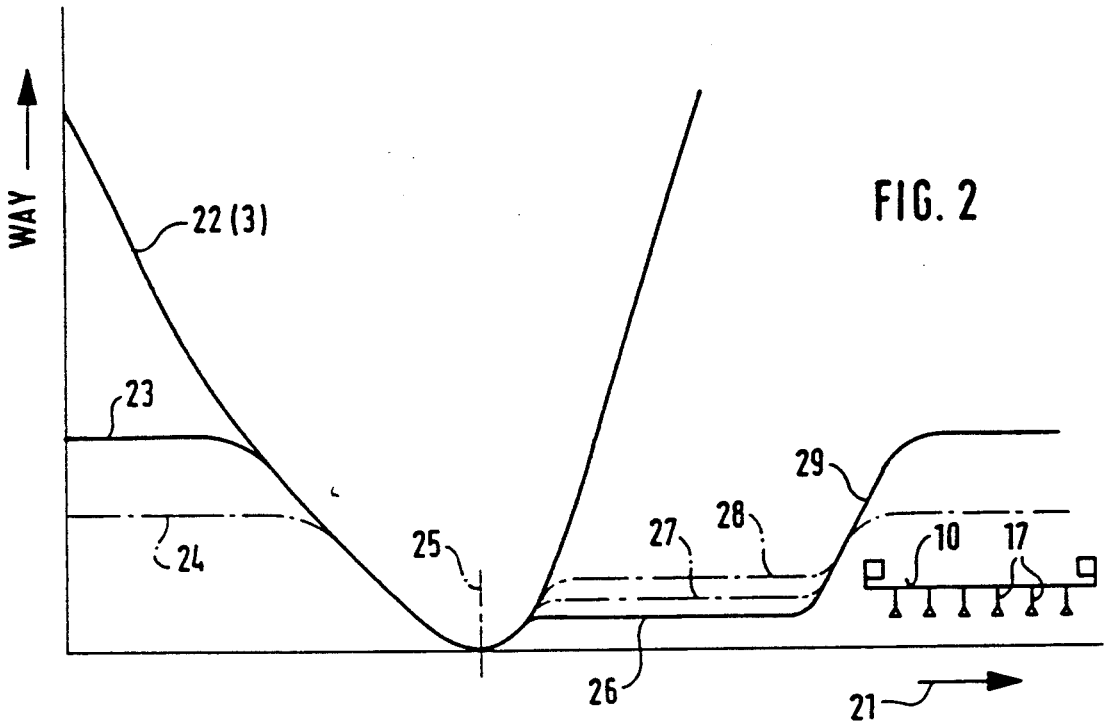
FIG. 2 is a representation of the invention by means of the course of a curve.

In this respect, FIG. 2 illustrates the dependencies of the movements of the slide 3, the suction bar 10 and the drawing apparatus 20.

Curve 22 represents the path of the slide 3 over the angle of rotation 21. Reference number 25 indicates the lower dead center of the slide 3. The movements of the drawing apparatus 20 have the reference number 23, 24 and 26 to 29. In order to explain the transfer of the sheet metal part 18 from the sheet metal holder 30 to the suction bridge 10, the suction bridge 10 is shown with the suction devices 17 in a sheet metal part removal position. Reference numbers 23 and 24 indicate different starting heights of the drawing apparatus 20 in order to comply with the tool conditions during the feeding. The illustrations point out two possible feeding heights for different sheet metal parts. In this case, the feeder 9 (FIG. 1) places a sheet metal part 18 on the sheet metal holder 30 (FIGS. 3 and 4) in the drawing apparatus 20. The lowering movement of the sheet metal holder 30 starts with the pre-acceleration stage for the transition into the movement of the slide 3, curve 22. The sheet metal part 18 and the sheet metal holder 30 are lowered by means of the top part 6 of the tool going down with the slide, the drawing stage.

After the lower dead center 25 has been reached, the drawing apparatus with the sheet metal holder 30 follows the upward-moving slide 3 and the top part 6 of the tool for a short time. However, already at this point, a delaying of the upward movement of the sheet metal holder 30 may take place with respect to the upward movement of the slide 3 by means of known locking measures. The sheet metal holder 30, which follows the slide 3 in this upward movement, lifts the sheet metal part 18 out of the bottom part 7 of the tool to such an extent that it can be gripped by the suction bridge 10 by means of the suction devices 17. For the transfer of the sheet metal part 18 to the suction devices 17, the sheet metal holder 30 is temporarily prevented from moving up farther. Depending on the tool or the drawing depth, by means of the press control and as a function of the angle of rotation, the stopping of the drawing apparatus 20 with the sheet metal holder 30 may take place at a removal height 26, at a removal height 27, at a removal height 28 or at any other removal height for the suction bar 10 and the sheet metal part 18 indicated by positions 26 to 28. After the temporary stoppage of the drawing apparatus 20 in one of the presettable removal positions 26, 27, 28, the drawing apparatus 20 must be moved upwards corresponding to the indicated curve 29 into the inserting position 23 or into the inserting position 24.

FIG. 3 shows an area between two press stands 4—for example, the first machining stage outlined in FIG. 1. The machining stage is designed as a drawing stage and, for this purpose, has a drawing apparatus 20 with drawing cylinders 31 which are fixedly mounted on the frame by means of a traverse 32. The drawing cylinders 31 can be discretely acted upon by pressure by way of the valves 33; that is, each drawing cylinder 31 can be controlled individually in the sense of an active or a passive presetting of pressure. By means of piston rods 36, the drawing cylinders 31, for externally arranged drawing cylinders 31, act upon pressure bolts 39 via pressure bolts 37 that are held axially with respect to the drawing cylinders 31. Via pressure pins 40, 42, these pressure bolts 39 act upon the sheet metal holder 30 in the bottom part 7 of the tool.

Reference number 5 refers to a sliding table; reference number 6 refers to the top part of the tool; and reference number 8 refers to the transfer device for the sheet metal parts 18 which, by means of the suction bars 10 and the suction devices 17, can be taken off the sheet metal holder 30. A console 34, which otherwise can be lifted and lowered, is supported by collars 38 on the pressure bolts 37.

When the console 34 is prevented from carrying out a movement, the movement of the pistons rods 36 of the drawing cylinders 31 and thus the lifting movement of the sheet metal holder 30 are also prevented. The sheet metal holder 30 can be lifted by, for example, 30 mm which may correspond to a removal position 26 or 27 or 28 in FIG. 2. In this position, the sheet metal part 18 can be removed from the sheet metal holder 30 by the suction devices 17 of the suction bar 10 and can be lifted into the transport height indicated by reference number 18[1]. The console 34 is rigidly connected with a lift bridge 47 by stay bolts 41. Spindles 44 are disposed on the lift bridge 47 so that they can be screwed out of and into the lift bridge 47. The spindles 44 interact with stop cylinders 45 which are fixed to the frame by a wing spar 43. In the following, the detailed arrangement will be explained with respect to FIG. 5. All stops have the reference number 35 and, as a result of their spindles 44, cause the adjusting of different removal positions 26, 27, 28.

With respect to the adjustment of the height of the sheet metal holder 30, FIG. 4 shows the same arrangement of the stops 35 as FIG. 3. The drawing cylinders 31 of the drawing apparatus 20 act via their piston rods 36 and pressure bolts 37 as well as by pressure bolts 39 onto a pressure cheek 46. On the pressure cheek 46, pressure pins 40 are supported which are placed from below against the sheet metal holder 30 in the bottom part 7 of the tool and have already lifted it into one of the removal positions 26, 27, 28 for a sheet metal part 18. The other reference numbers correspond to parts which have the same structure or the same function as in FIG. 3.

Figure 5:
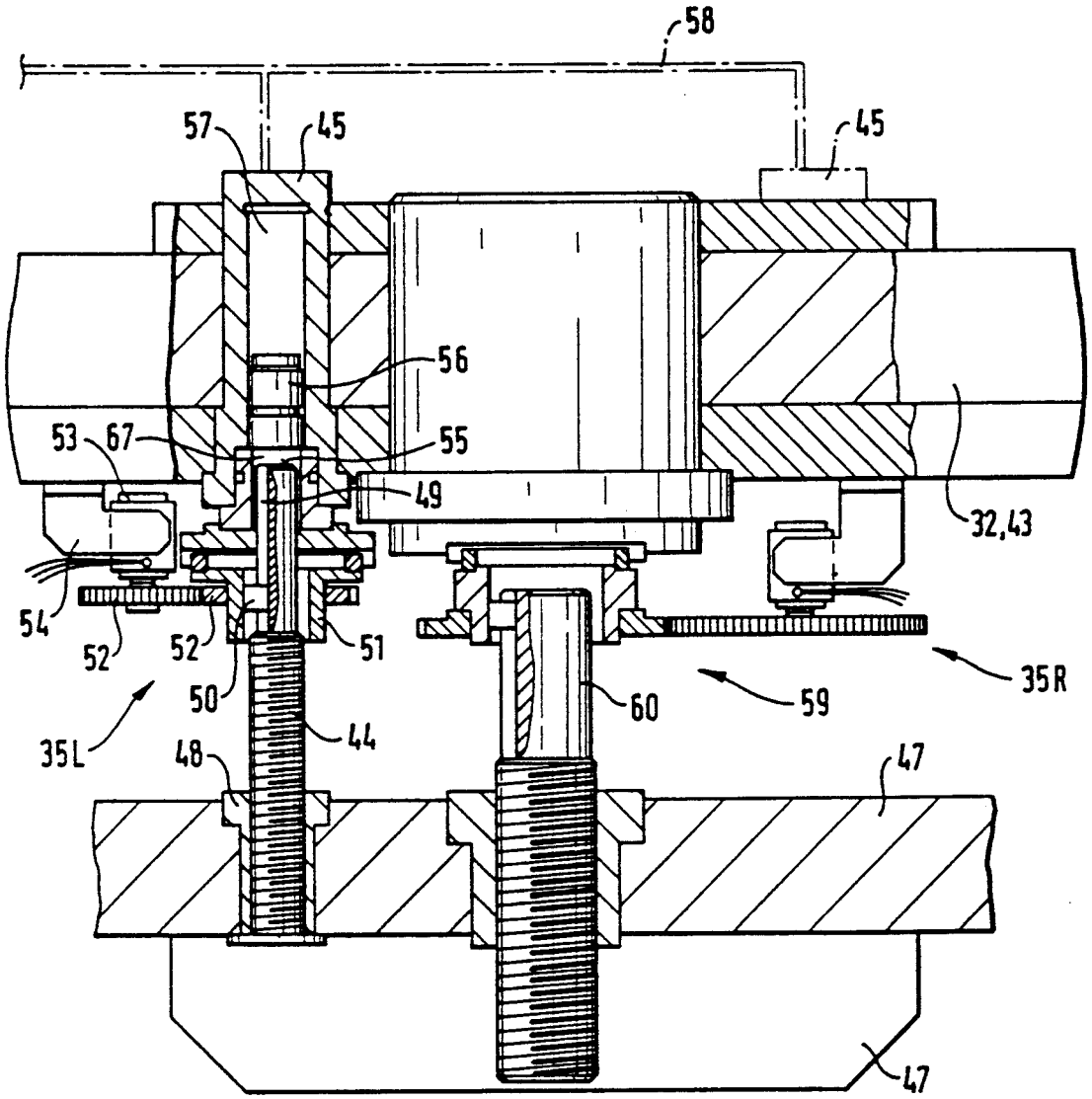
FIG. 5 is a sectional view of a stop constructed in accordance with an embodiment of the present invention.

FIG. 5 shows in more detail the stop area for the console 34 illustrated in FIGS. 3 and 4. A left stop 35L is illustrated with a right stop 35R only being outlined in order to permit the view of an upward-carrying end stop which as a whole has the reference number 59. The stops 35 (35L, 35R) each have a spindle 44. The spindle 44 is rotatably held in a threaded bush 48 in the lift bridge 47 and thus can be screwed out of it and into it. The end part 55 of the spindle 44 interacts with the piston 56 of a stop cylinder 45. The pressure space 57 of the stop cylinder 45 can be filled up through a pressure pipe 59 with a pressure medium corresponding to the construction of the wiring shown in FIG. 6. When the pressure space 57 is acted upon by pressure, the piston 56 is in its lower end position, and a distance (gap) 67 is formed between the piston bottom and the opposite end part 55 which makes it possible to lift the lift bridge 47 by this extent by means of the drawing cylinders 31 (FIGS. 3 and 4).

In its upper area close to the end part 55, the spindle 44 has a groove 49. A feather key 50, which is held in a collar bush 51, is inserted into the groove 49. A toothed gear of a gear pair 52 is placed on the collar bush 51. The toothed gear pair 52 can be acted upon rotationally by a motor 53 held fixedly on the frame in a holding angle 54. The rotation of the collar bush 51 with the feather key 50 causes a change of the gap 67 between the piston 56 and the end part 55 of the spindle 44 by taking along the spindle 44. The gap 67 is therefore decisive for the removal positions 26, 27 or 28 or each intermediate extent of the upward-guided sheet metal holder 30.

The height 23, 24 of the sheet metal holder in FIG. 2 for the inserting of the new sheet metal part 18 can be adjusted by the rotation of the spindle 60 of the upward-carrying stop 59.

Figure 6:
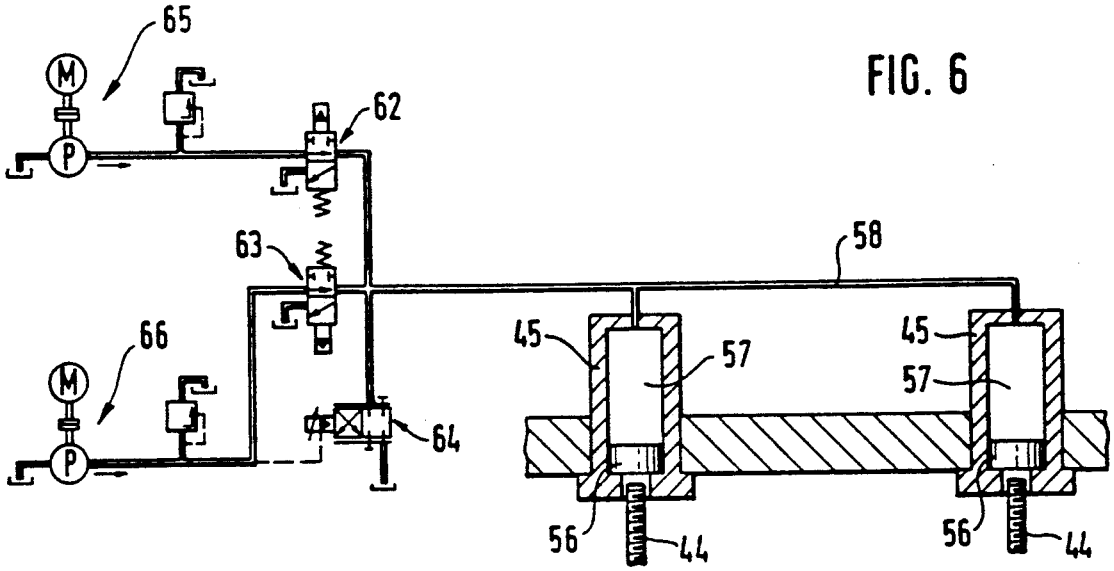
FIG. 6 is a wiring diagram for the control of the cylinders of the stop.

According to the wiring diagram in FIG. 6, the pressure spaces 57 of the stop cylinders 45 can be connected via the pressure pipe 58 and distributing valves 62 and 63 with a low-pressure source 65 with a large volume delivery and/or a high-pressure source. By means of the proportional distributing valve 64, the course of the curve 29 (FIG. 2) and therefore the upward movement of the sheet metal holder 30 can be adjusted after the removal of the sheet metal part 18.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A method of operating a press having a press frame, at least one slide and a press bed for top and bottom parts of tools, with the press bed having a tool-side sheet metal holder, a transfer device for transporting of sheet metal parts through the press, a drawing device, a liftable and lowerable console through which piston rods of drawing cylinders act on the sheet metal holder to eject the sheet metal parts, the console being operatively connected to a stop that is fixed to the press, and a lifting-lowering drive for the transfer device that lifts and lowers the transfer device, the method comprising:

adjustably controlling a stop position of the console;

moving the console upwardly after passing through a lower dead center of the slide and the drawing device;

temporarily stopping the upward movement of the console as a function of a slide path or an angle of rotation at a height determined by the stop;

controlling movements of the transfer device via the lifting-lowering drive in coordination with the movement of the console as a function of the slide path or the angle of rotation until the sheet metal parts are gripped by the transfer device in the temporarily stopped upward movement of the console.

* * * * *